US011398675B2

(12) United States Patent
Gershenzon

(10) Patent No.: US 11,398,675 B2
(45) Date of Patent: Jul. 26, 2022

(54) ANTENNA FOR RECEIVING DATA FROM LOW EARTH ORBIT SATELLITES

(71) Applicant: Vladimir Evgenievich Gershenzon, Moscow (RU)

(72) Inventor: Vladimir Evgenievich Gershenzon, Moscow (RU)

( * ) Notice: Subject to any disclaimer, the term of this patent is extended or adjusted under 35 U.S.C. 154(b) by 325 days.

(21) Appl. No.: 16/644,728

(22) PCT Filed: Aug. 29, 2017

(86) PCT No.: PCT/RU2017/000627
§ 371 (c)(1),
(2) Date: Mar. 9, 2020

(87) PCT Pub. No.: WO2019/045585
PCT Pub. Date: Mar. 7, 2019

(65) Prior Publication Data
US 2022/0115779 A1 Apr. 14, 2022

(51) Int. Cl.
*H01Q 3/12* (2006.01)
*H01Q 3/18* (2006.01)

(52) U.S. Cl.
CPC ..... *H01Q 3/18* (2013.01)

(58) Field of Classification Search
CPC ..... H01Q 15/14; H01Q 1/12; H01Q 3/12; H01Q 3/14; H01Q 3/18; H01Q 19/10
See application file for complete search history.

(56) References Cited

U.S. PATENT DOCUMENTS 2,991,473 A * 7/1961 Van Staaden ..... G01S 1/02 343/756
3,407,404 A * 10/1968 Cook ..... H01Q 19/19 343/765

(Continued)

FOREIGN PATENT DOCUMENTS

CN 201838708 U 5/2011

OTHER PUBLICATIONS

B.Y. Duan On design and experiment of the feed cable-suspended structure. Mechatronics 19 (2009), p. 503-509.

*Primary Examiner* — Tho G Phan
(74) *Attorney, Agent, or Firm* — Ipsilon USA, LLP

(57) ABSTRACT

The present invention relates to a feed-motion antenna device. Provided is an antenna for receiving data from low Earth orbit satellites, the antenna comprising a fixedly mounted antenna reflector, a moveable feed, a feed positioner configured to move the feed in the focal plane of the antenna reflector, the feed positioned having a primary rotation axis and an auxiliary rotation axis, and a control device configured to send control signals to the feed positioner. The primary rotation axis of the feed positioner passes through the center of the antenna reflector and the primary rotation axis is perpendicular to the focal plane of the antenna reflector; the auxiliary rotation axis of the feed positioner is parallel to the primary rotation axis. The feed positioner comprises an equal-arm structure comprising a first arm and a second arm, and each arm is arranged in a plane perpendicular to the primary and auxiliary rotation axes. The first arm is connected at one its end to the primary rotation axis and adapted to be rotated around the primary rotation axis, the feed is connected to an end of the second arm, and the first arm and the second arm are connected to each other at the auxiliary rotation axis and are adapted to be rotated with respect to each other. The diameter of the (Continued)

antenna reflector is at least 1.5 m, and the focal length of the antenna reflector is at least 1.0 m.
Further provided is a method for receiving satellite data by means of the offered antenna.

11 Claims, 3 Drawing Sheets

(56) References Cited

U.S. PATENT DOCUMENTS

| | | | | | |
|---|---|---|---|---|---|
| 3,848,255 | A * | 11/1974 | Migdal | H01Q 15/23 | 343/911 L |
| 4,010,472 | A * | 3/1977 | Mountcastle | H01Q 3/12 | 343/777 |
| 4,298,877 | A * | 11/1981 | Sletten | H01Q 3/18 | 343/837 |
| 5,714,960 | A | 2/1998 | Choi | | |
| 5,751,254 | A | 5/1998 | Bird et al. | | |
| 6,204,822 | B1 | 3/2001 | Cardiasmenos et al. | | |
| 10,665,929 | B2 * | 5/2020 | Gaudette | H01Q 1/1235 | |
| 2002/0011958 | A1 * | 1/2002 | Ogawa | H01Q 25/00 | 343/763 |

* cited by examiner

ANTENNA FOR RECEIVING DATA FROM LOW EARTH ORBIT SATELLITES

RELATED APPLICATION

This application is a National Phase of PCT/RU2017/000627 filed on Aug. 29, 2017, the entirety of which are incorporated by reference.

FIELD OF THE INVENTION

The present invention relates to a feed-motion antenna device and is designed for receiving Earth observation data streams from low Earth orbit satellites in space.

BACKGROUND OF THE INVENTION

A large variety of terrestrial satellite antenna structures is presently known in the art. Reflector antennae are the most widely used type of satellite antennae.

A feed-motion antenna (with a movable reflector) is a widely used structure for a mechanical or electromechanical antenna for receiving signals from a satellite. However, this solution requires a complex mechanism for displacing the entire antenna structure.

Further, scanning can be accomplished by displacing a feed with a fixedly mounted antenna reflector. This solution provides a simplified antenna structure with enhanced mobility and versatility.

For example, U.S. Pat. No. 5,751,254 A discloses a feed movement mechanism and a control system for a multibeam antenna for tracking satellites from a geostationary orbit. In the prior art antenna, feeds are moved along a non-planar focal surface of the antenna. Further, the satellite can be tracked to some degree by moving the feed along the non-planar focal surface of the antenna on rails.

The disadvantage of the prior art structure is that the antenna comprises two reflectors and several feeds, thus significantly increasing weight of the antenna structure. The antenna frame which provides a support structure for two reflectors and means for moving feeds further contributes to weight of the structure; furthermore, the frame is complex and difficult to assemble and install. It should further be noted that the received signal can contain noise when using several feeds.

Further, CN 201838708 U discloses a rapidly erected and folded portable type paraboloid satellite receiving antenna comprising an antenna reflection panel, a feed source tuner assembly, and respective supporting and adjusting mechanisms thereof. The prior art antenna is compact, practical, easy to carry, and can be used in the field.

However, the prior art antenna does not comprise automatic position re-tuning for the feed or antenna reflector; thus, the system requires an on-site visit by a specialist in order to redirect antenna to a different position. Furthermore, the feed movability does not provide full use of the entire available antenna reflector aperture.

Some of the above drawbacks were addressed in the antenna system (U.S. Pat. No. 6,204,822 B1) for communicating between an Earth station and a satellite. The antenna system is used for communicating with low- and mid-earth orbiting satellites and comprises a broadband satellite communications system operating in the microwave and millimeter wave frequency bands. The antenna system employs one or more spherical reflectors (each a truncated spherical surface) and moveable feeds interacting therewith and providing mechanical scanning. The feed is driven by a two-axis positioner.

The disadvantage of the prior art antenna is that positioner axes are arranged in several planes with respect to the reflector plane; therefore, controlling the positioner becomes more difficult when moving the feed, thus increasing the risk of scanning error. Furthermore, when one antenna is used, only a narrow section of satellite trajectory is scanned over a short time period due to the fact that the antenna reflector shape being a spherical reflector is characterized by significant height, and the positioner structure provides only partial surface exposure for the spherical reflector. When using several antenna reflectors, the structure weight increases and the process of installing the antenna system becomes more complex.

Long-focus reflectors are considered best suited for receiving high-speed Earth observation data streams from low Earth orbit satellites in space due to wide antenna aperture. However, said reflectors require more precise calculation and reflector tuning. A moveable feed provides a solution to this problem. However, prior art feed-motion antenna structures lack a feed positioner required for interaction with a long-focus reflector and providing high quality data reception from space. Furthermore, it is of present interest to provide a technologically simple antenna structure that is easy to install and does not require an on-site visit by a specialist.

Therefore, there is a need in such a structure providing simple assembly, installation and maintenance along with enhanced versatility allowing to track and receive signals in standalone mode from low Earth orbit satellites which are currently widely used, e.g., for ecological monitoring and infrastructure monitoring.

In light of the foregoing, the object of the present invention is to provide an easily mounted antenna for receiving data from low Earth orbit satellites, the antenna having a structure providing signal reception from the widest possible satellite trajectory section in standalone mode.

SUMMARY OF THE INVENTION

The object of the invention is achieved by an antenna for receiving data from low Earth orbit satellites, the antenna comprising a fixedly mounted antenna reflector, a moveable feed, a feed positioner configured to move the feed in the focal plane of the antenna reflector, the feed positioned having a primary rotation axis and an auxiliary rotation axis, and a control device configured to send control signals to the feed positioner. The primary rotation axis of the feed positioner passes through the center of the antenna reflector and the primary rotation axis is perpendicular to the focal plane of the antenna reflector; the auxiliary rotation axis of the feed positioner is parallel to the primary rotation axis. The feed positioner comprises an equal-arm structure comprising a first arm and a second arm, and each arm is arranged in a plane perpendicular to the primary and auxiliary rotation axes. The first arm is connected at one its end to the primary rotation axis and adapted to be rotated around the primary rotation axis, the feed is connected to an end of the second arm, and the first arm and the second arm are connected to each other at the auxiliary rotation axis and are adapted to be rotated with respect to each other. The diameter of the antenna reflector is at least 1.5 m, and the focal length of the antenna reflector is at least 1.0 m.

The present invention provides a technologically simple, easily mounted structure providing a high quality data reception from the space by a long-focus antenna. Furthermore, the present invention contributes to a wider array of structures for antenna systems.

The technical result is achieved by means of configuration of an antenna for receiving data from low Earth orbit satellites, wherein the primary rotation axis of the feed positioner passes through the center of the antenna reflector and is perpendicular to the focal plane of the antenna reflector; the auxiliary rotation axis of the feed positioner is parallel to the primary rotation axis; and the feed positioner comprises an equal-arm structure with each arm arranged in a plane perpendicular to the primary and auxiliary rotation axes, wherein the first arm is connected at one end to the primary rotation axis and adapted to be rotated around the primary axis, the feed is connected to an end of the second arm, wherein the first arm and the second arm are connected to each other at the auxiliary rotation axis and are adapted to be rotated with respect to each other; and wherein the diameter of the antenna reflector is at least 1.5 m, and the focal length of the antenna reflector is at least 1.0 m.

It is apparent to those skilled in the art that in order to provide high-quality data reception/transfer, the moving feed should be arranged in the focal plane of the antenna reflector. The focal plane of a wide-aperture long-focus reflector is generally parallel to the antenna plane, i.e., the plane characterizing antenna configuration. Due to the fact that the primary rotation axis of the feed positioner passes through the center of the antenna reflector and is perpendicular to the focal plane of the antenna reflector, and the auxiliary rotation axis is parallel to the primary rotation axis, and due to the fact that the arms of the positioner are positioned in a plane perpendicular to the primary and auxiliary rotation axes, the positioner is capable of moving the feed in the focal plane.

Furthermore, by means of offered arrangement of the primary and auxiliary rotation axes and of the equal-arm structure, wherein the first arm is connected at one end to the primary rotation axis and adapted to be rotated around the primary axis, the feed is connected to an end of the second arm, and the first arm and the second arm are adapted to be rotated with respect to each other at the point of connection between said arms, said point being located at the auxiliary rotation axis, provides the arrangement wherein the feed can be located both at the focal point and at any point of the focal plane. Thus, the provided antenna is capable of using the entire plane of the antenna reflector excluding possibility of appearance of dead zones, which provides high quality of information received from the space by the long-focus antenna.

The optimal dimensions for the antenna are as follows: the diameter of the antenna reflector of at least 1.5 m, and the focal length of the antenna reflector of at least 1.0 m. Such dimensions allow receiving high-speed information data streams from low Earth orbit satellites, while also providing low antenna weight and ease of transportation.

Also proposed antenna is further easy to manufacture due to the antenna reflector installed in a fixed position (stationary relative to the Earth surface), i.e. there is no mechanism in the antenna for positioning the antenna reflector, which excludes a large number of components, which further simplifies the structure and provides more convenient antenna transportation. Furthermore, the antenna is easy to mount on any surface.

It is also important that the feed is moved by means of the control device configured to send control signals to the feed positioner. The control device allows directing the feed precisely to the required position in the focal plane, and further allows tracking the maximum possible satellite trajectory section by moving the feed. The ability for standalone feed operation simplifies antenna maintenance by not requiring on-site visits by a specialist.

According to one of the embodiments, the antenna reflector is fixed in a horizontal plane with respect to the Earth surface. Proposed arrangement of the antenna reflector simplifies the installation process and contributes to structure security and durability due to uniform distribution of forces affecting the structure. Further, the horizontal position of the antenna reflector allows to scale (e.g., scale up) the diameter thereof without a significant weight increase of the antenna fastening assembly and without an increase in expenditures for components. Offered solution is aimed at providing maximum efficiency when using a surface of the reflector.

According to another one embodiment, the auxiliary rotation axis of the feed positioner is arranged within the antenna reflector. The positioner arms engaged with each other at a point located at the auxiliary rotation axis provide the feed with access to any required point on the focal plane. Positioning the auxiliary rotation axis outside the boundaries of the antenna reflector is impractical. Furthermore, positioning said axis within the boundaries of the antenna reflector leads to a decrease in metal consumption in the equal-arm structure of the positioner, and therefore, to weight reduction of the structure.

According to another one embodiment, the feed is configured to perform curvilinear movement. The positioner structure allows moving the feed to any point on the focal plane in various ways, including curvilinear movement, wherein the curvilinear movement of the feed facilitates achieving the optimal trajectory thereof.

According to another one embodiment, the antenna comprises a radio transparent cover mounted above the antenna reflector and the feed positioner. The cover protects the mechanical and electrical parts of the antenna from precipitation like a rain having a significant effect on data reception quality. Furthermore, the radio transparent cover can be a part of the supporting structure of the feed positioner.

According to another one embodiment, the antenna is operated in the X band. The X band allows for data reception from low Earth orbit satellites. Further, small-size antennae operating in the above range are easy to manufacture, which facilitates transportation, thus simplifying antenna usage.

According to another one embodiment, the feed positioner comprises drives adapted to drive components of the feed positioner. This solution allows moving the arms of the feed positioner, and therefore allows moving the feed.

According to another one embodiment, the control device is configured to control the feed positioner based on predetermined control modes. The feed movement trajectory in the focal plane can be defined beforehand if time interval and movement trajectory of a satellite located within the antenna reception area are known. Therefore, the feed positioner based on defined control modes provides an automated structure.

Preferably, the diameter of the antenna reflector is 2.0 m, and the focal length of the antenna reflector is 1.4 m. Such dimensions allow receiving high-speed information data streams from low Earth orbit satellites, while also retaining low antenna weight and ease of transportation.

The object is further achieved by a method for receiving data by the provided antenna for receiving data from low Earth orbit satellites, the method includes receiving a signal about coming satellite via the control device, sending control signals from the control device to the feed positioner, and moving the feed by means of the positioner with respect to the antenna reflector in accordance with the control signals. The feed is moved during at least one time interval, during which the first arm and/or the second arm is/are rotated.

The technical result of the offered method is an increase in coverage area during scanning using the antenna, at the same time further providing high satellite data reception accuracy.

According to one of the embodiments, the control signals provide movement of the feed based on predetermined control modes.

Therefore, the offered antenna structure allows receiving signals from the widest possible satellite trajectory section by using a long-focus antenna reflector and a feed moveable with respect to the reflector. The proposed positioner structure provides stable and steady feed movement in focal plane, allowing receiving high-speed Earth observation data streams of high spatial resolution from low Earth orbit satellites. Furthermore, the offered antenna meets all structural security and durability requirements, is technologically simple and easy to install.

BRIEF DESCRIPTION OF THE DRAWINGS

The present invention is further explained in the following detailed description with reference to accompanying drawings, wherein.

DETAILED DESCRIPTION

The proposed antenna for receiving data from low Earth orbit satellites comprises a long-focus antenna reflector with a moveable feed.

Figure 1:
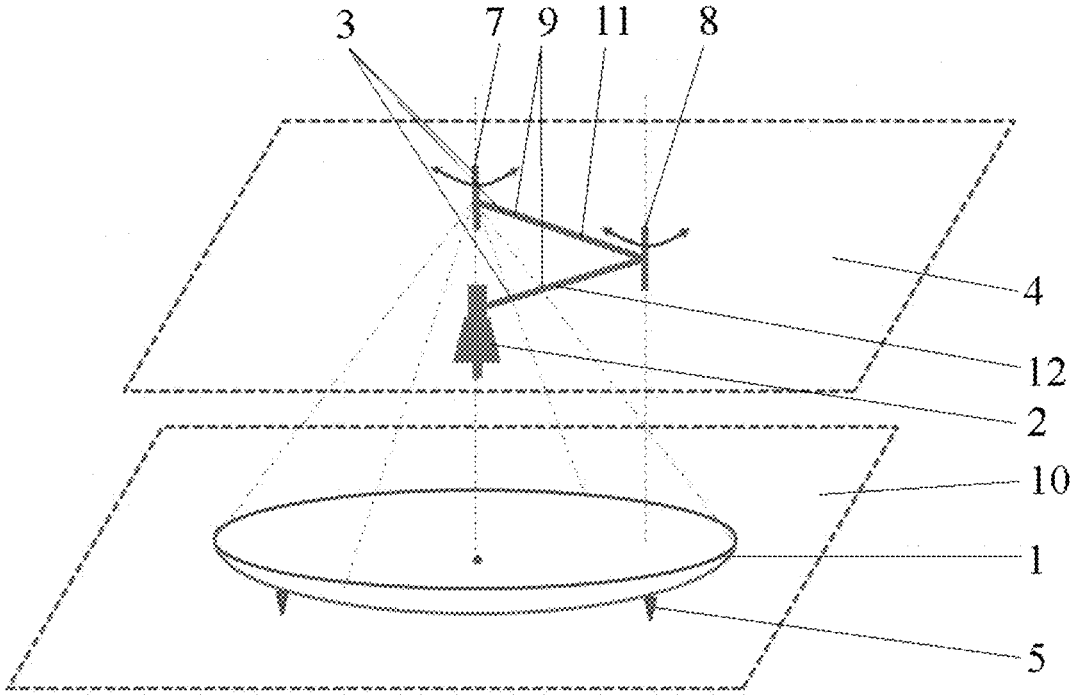
FIG. 1 shows a schematic illustration of the antenna structure according to one embodiment of the present invention.
Figure 2:
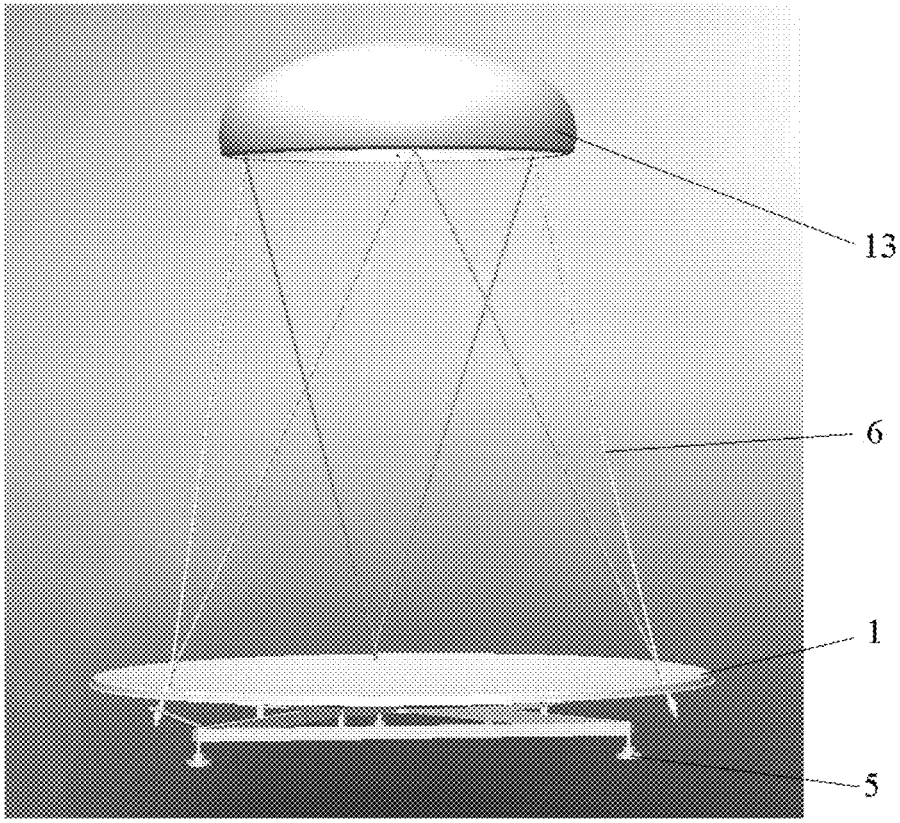
FIG. 2 shows an antenna with a radio transparent cover according to one embodiment of the present invention.

The antenna for receiving data from low Earth orbit satellites (FIG. 1) comprises a fixedly mounted antenna reflector 1 having a paraboloid shape with a wide aperture (a long-focus antenna reflector). The antenna further comprises a moveable feed 2 and a feed positioner 3 configured to move the feed 2 in the focal plane 4 of the antenna reflector 1. The feed 2 structure does not include a counter-reflector used in the prior art, thus reducing antenna reflector 1 blockage. The antenna further comprises a control device (not shown) configured to send control signals to the feed positioner. In this embodiment, the antenna reflector 1 is a parabolic reflector and is mounted on a surface by means of legs 5 which constitute a part of the antenna supporting structure. The supporting structure further comprises a frame 6 (FIG. 2) retaining the feed 2 positioner 3.

In other embodiments, the antenna reflector can have a modified shape and can be fixedly mounted in a different manner, e.g., by hanging or mounting on a support.

Paraboloid reflectors particularly differ in the ratio of focal length to aperture diameter (f/D). Long-focus antennae are antennae having an f/D ratio greater than 0.5, whereas short-focus antennae have an f/D ratio less than 0.3. In turn, focal length is associated with reflector depth, i.e., the smaller the focal length, the deeper the reflector. Reflector depth has a significant effect on electrical parameters of the antenna. Smaller reflectors are fed more uniformly compared to deep reflectors, which contributes to a higher amplification coefficient.

The technical result of providing a technologically simple, easily mounted structure providing high quality data reception from space by a long-focus antenna is achieved by the positioner 3 comprising a primary rotation axis 7 and an auxiliary rotation axis 8, wherein the primary rotation axis 7 of the feed 2 positioner 3 passes through the center of the antenna reflector 1 and is perpendicular to the focal plane of the antenna reflector 1, whereas the auxiliary rotation axis 8 of the feed 2 positioner 3 is parallel to the primary rotation axis 7.

The technical result is further achieved by the feed 2 positioner 3 comprising an equal-arm structure 9, each arm thereof arranged in a plane perpendicular to the primary 7 and auxiliary 8 rotation axes. The first arm 11 is connected at one end to the primary rotation axis 7 and adapted to be rotated around the primary axis 7, the feed 2 is connected to an end of the second arm 12, wherein the first arm 11 and the second arm 12 are adapted to be rotated with respect to each other at the point of connection between said arms, said point being located at the auxiliary rotation axis 8. The diameter of the antenna reflector 1 is at least 1.5 m, and the focal length of the antenna reflector 1 is at least 1.0 m.

The focal plane of a wide-aperture long-focus reflector is generally parallel to the antenna plane. Due to the fact that the primary rotation axis 7 of the feed 2 positioner 3 passes through the center of the antenna reflector 1 and is perpendicular to the focal plane 4 of the antenna reflector 1, and the auxiliary rotation axis 8 is parallel to the primary rotation axis 7, and due to the fact that the arms 11, 12 of the positioner 3 are disposed in a plane perpendicular to the primary and auxiliary rotation axes 7, 8, the positioner 3 is capable of moving the feed 2 in the focal plane 4.

Furthermore, the offered arrangement of the primary and auxiliary rotation axes 7,8 and of the equal-arm structure, wherein the first arm 11 is connected at one end to the primary rotation axis 7 and adapted to be rotated around the primary axis 7, the feed 2 is connected to an end of the second arm 12, wherein the first arm 11 and the second arm 12 are adapted to be rotated with respect to each other at the point of connection between said arms, said point being located at the auxiliary rotation axis 8, provides the arrangement wherein the feed 2 can be located both at the focal point and at any point of the focal plane 4. Thus, such arrangement allows using the entire plane of the antenna reflector, excluding possibility of appearance of dead zones, which provides high quality of information received from space by the long-focus antenna.

The optimal dimensions for the antenna are as follows: the diameter of the antenna reflector of at least 1.5 m, and the focal length of the antenna reflector of at least 1.0 m. Such dimensions are aimed at achieving lowest possible antenna reflector feed loss and allow receiving high-speed information data streams from low Earth orbit satellites. Furthermore, the disclosed antenna dimensions provide a lightweight and easily transported device.

It is of further note that the feed is moved by means of the control device (not shown) configured to send control signals to the feed 4 positioner 3. The control device allows directing the feed 4 precisely to the required position in the focal plane 4, and further allows tracking the maximum possible satellite trajectory section by moving the feed 2. The ability for standalone feed 4 operation simplifies antenna maintenance by not requiring on-site visits by a specialist.

The proposed antenna is further easy to manufacture due to the antenna reflector installed in a fixed position (stationary relative to the Earth surface), i.e. there is no mechanism in the antenna for positioning the antenna reflector, which excludes a large number of components, which further simplifies the structure and provides more convenient antenna transportation. Furthermore, the antenna is easy to mount on any surface.

The preferred orientation of the antenna reflector 1 is fixedly mounted in a horizontal plane with respect to Earth surface. The offered arrangement of the antenna reflector 1 simplifies the installation process and contributes to structure security and durability due to uniform distribution of forces affecting the structure. Further, the horizontal position of the antenna reflector 1 allows to scale (e.g., scale up) the diameter thereof without a significant weight increase of the antenna fastening assembly and without an increase in expenditures for components. The disclosed solution is aimed at providing maximum efficiency in reflector surface use.

Another important feature of the present invention is the positioning of the auxiliary rotation axis 8 of the feed positioner within the antenna reflector 1. The positioner 3 arms 11, 12 engaged with each other at a point located at the auxiliary rotation axis 8 provide the feed 4 with access to any required point on the focal plane. Positioning the auxiliary rotation axis 8 outside the antenna reflector 1 is impractical. Furthermore, positioning said axis within the antenna reflector 1 leads to a decrease in metal consumption in the equal-arm structure 9 of the positioner 3, and therefore, to weight reduction of the structure.

Further, the feed can perform linear and/or curvilinear movement thereof. The positioner structure allows moving the feed 2 to any point on the focal plane 4. The curvilinear movement of the feed 2 facilitates achieving the optimal trajectory thereof.

In order to protect the mechanical and electrical part of the antenna from precipitation having a significant effect on reception quality, a radio transparent cover 13 mounted above the antenna reflector 1 and the feed 2 positioner 3 is used in some embodiments. Furthermore, the radio transparent cover 13 can be a part of the supporting structure of the feed positioner. In the preferred embodiment, the cover is made of a plastic or Plexiglas which provide the least data loss in the X band.

The most suitable frequency band providing data reception from low Earth orbit satellites is the X band. Further, small-size antennae operating in the above range are easy to manufacture, which facilitates transportation, thus simplifying antenna usage.

In order to move the positioner, and thus the feed, drives can be used at connection points of the equal-arm structure, said points located at the primary and auxiliary axes. This solution allows moving positioner arms both simultaneously and individually, thus providing precise feed positioning.

An embodiment is contemplated wherein the control device is configured to control the feed positioner based on predetermined control modes. The feed movement trajectory in the focal plane can be defined beforehand if time interval and movement trajectory of a satellite located within the antenna reception area are known. Therefore, the feed positioner based on predetermined control modes provides an automated structure.

Data reception from low Earth orbit satellites by means of the antenna can be carried out as follows. When the antenna is not already installed, the antenna is transported to the installation area and the antenna reflector 1 is positioned in a manner providing capture required satellite trajectory. The antenna frame 6 is then mounted, and the positioning mechanism 3 and the feed 2 are mounted thereon. When the satellite approaches, a signal regarding the approaching satellite is received by the control device (not shown); control signals are then sent from the control device to the feed 2 positioner 3. Then the feed 2 is moved by means of the positioner 3 with respect to the antenna reflector 1 in accordance with control signals. The feed 2 is moved during at least one time interval, during which the first arm 11 and/or the second arm 12 is (are) rotated in order to provide linear and/or curvilinear feed movement.

The disclosed method for receiving data by an antenna provides a technical result of an increase in coverage area during scanning using the antenna, while further providing high satellite data reception accuracy.

It is further contemplated that the control signals provide feed movement by means of the positioner based on predetermined control modes. For example, in this case the feed is moved at set times by rotating the first arm and the second arm simultaneously or sequentially in any required manner in order to position the feed as required.

In preferred embodiments, antennae for receiving data from low Earth orbit satellites should comprise long-focus reflectors with the f/D ratio equal or greater than 0.6. Such configuration allows utilizing only parallel feed movement in the focal plane of the reflector to control beam scanning, thus providing maximum simplification of the kinematic diagram. The above parameters are best met by an antenna reflector with the diameter of 2 m and the focal length of 1.4 m; further, X-band wavelength feed rotation area radius is up to 0.5 m. Such antenna parameters allow tracking low Earth orbit satellites (about 600-650 km above the Earth surface) during a short zenithal trajectory section (about 30 seconds corresponding to 200 km of trajectory distance) in order to receive high-speed (up to 500 Mbit/s) Earth surface information data streams from space, providing images of the Earth surface with spatial resolution of 1 meter and higher. In the disclosed embodiment, the antenna services a local area with a radius of 100-150 km from the installation point. This antenna configuration provides optimal data reception parameters while retaining compact dimensions of the antenna.

It should be noted that the present invention can be used in various applications, including emergency situations, educational programs, ecological monitoring, local (regional) weather forecast, forestry, agriculture, infrastructure monitoring (monitoring buildings, roads, oil and gas pipelines, etc.), logistics services, etc.

Figure 3:
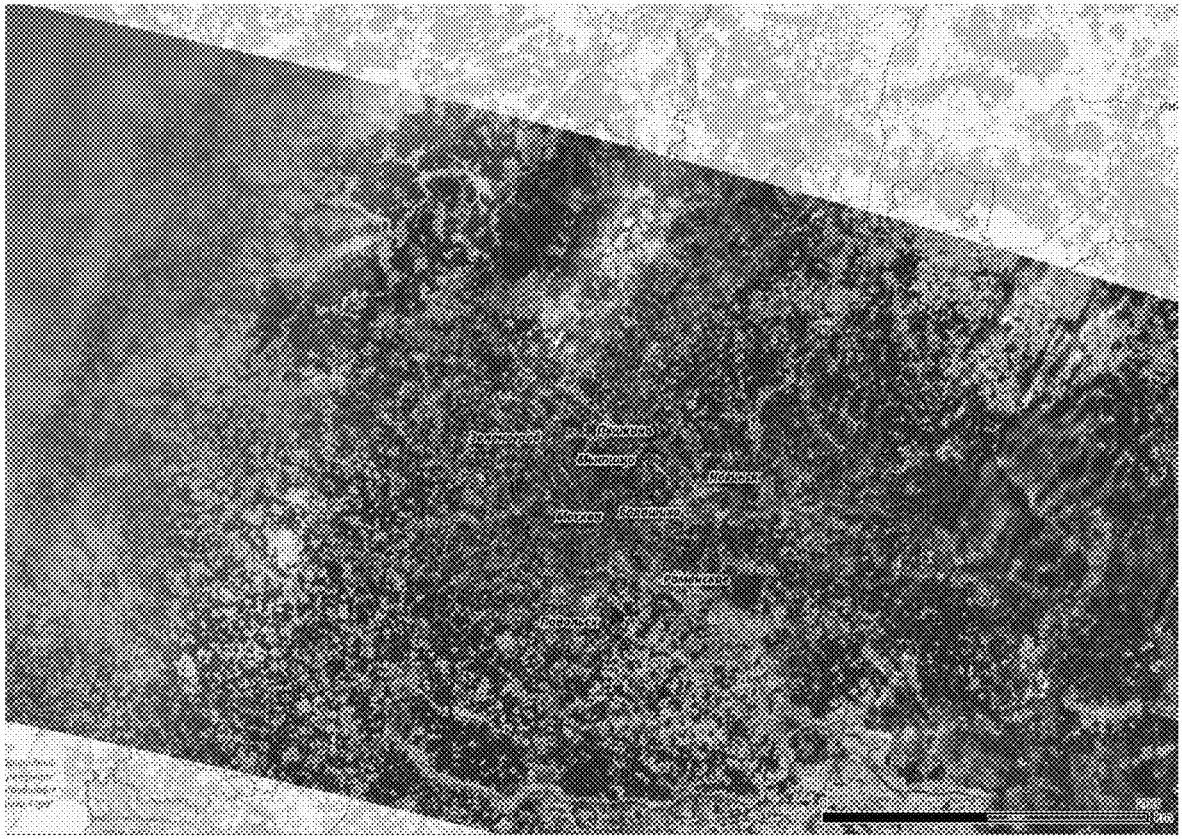
FIG. 3 shows an example of an image received by the antenna from an active remote Earth sensing satellite.

In order to prove functionality of the antenna, FIG. 3 shows an image received by the antenna for receiving data of the present invention from the Terra satellite on Dec. 7, 2016 in Moscow.

Therefore, the offered antenna structure allows receiving signals from the widest possible satellite trajectory section by using a long-focus antenna reflector and a feed moveable with respect to the reflector. The offered positioner structure provides stable and steady feed movement in focal plane, allowing to receive high-speed Earth observation data streams of high spatial resolution from low Earth orbit satellites. The offered antenna meets all structural security and durability requirements, is technologically simple and easy to install.

The present invention is not meant to be limited by the particular embodiments disclosed in the description by way of example; the invention includes all possible modifications and alternative embodiments falling within the spirit and scope of the present invention defined in the accompanying claims.

The invention claimed is:

1. An antenna for receiving data from low Earth orbit satellites, the antenna comprising:

a fixedly mounted antenna reflector, a moveable feed, a feed positioner configured to move the feed in the focal plane of the antenna reflector, the feed positioner having a primary rotation axis and an auxiliary rotation axis, and a control device configured to send control signals to the feed positioner, the feed positioner comprises a first arm and a second arm, the feed is connected to an end of the second arm, and the first arm and the second arm are connected to each other at the auxiliary rotation axis and are adapted to be rotated with respect to each other, and wherein the first arm is connected at one its end to the primary rotation axis and is adapted to be rotated around the primary rotation axis, wherein the primary rotation axis of the feed positioner passes through a center of the antenna reflector and the primary rotation axis is perpendicular to the focal plane of the antenna reflector, the auxiliary rotation axis of the feed positioner is parallel to the primary rotation axis, the first and second arms form an equal-arm structure, each arm being arranged in a plane perpendicular to the primary and auxiliary rotation axes, wherein the diameter of the antenna reflector is at least 1.5 m, and the focal length of the antenna reflector is at least 1.0 m.

2. The antenna according to claim 1, wherein the antenna reflector is fixed in a horizontal plane with respect to the Earth surface.

3. The antenna according to claim 1, wherein the auxiliary rotation axis of the feed positioner is arranged within the antenna reflector.

4. The antenna according to claim 1, wherein the feed is configured to perform curvilinear movement.

5. The antenna according to claim 1, further comprising a radio transparent cover mounted above the antenna reflector and the feed positioner.

6. The antenna according to claim 1, wherein the antenna is operated in the X band.

7. The antenna according to claim 1, wherein the feed positioner comprises drives adapted to drive components of the feed positioner.

8. The antenna according to claim 1, wherein the control device is configured to control the feed positioner based on predetermined control modes.

9. The antenna according to claim 1, wherein the diameter of the antenna reflector is 2.0 m, and the focal length of the antenna reflector is 1.4 m.

10. A method for receiving data by the antenna for receiving data from low Earth orbit satellites according to claim 1, including:

receiving a signal about coming satellite via the control device, sending control signals from the control device to the feed positioner, moving the feed by means of the positioner with respect to the antenna reflector in accordance with the control signals, wherein the feed is moved during at least one time interval during which the first arm and/or the second arm is/are rotated.

11. The method according to claim 10, wherein the control signals provide movement of the feed based on predetermined control modes.

* * * * *